United States Patent [19]

Mine et al.

[11] Patent Number: 4,773,508

[45] Date of Patent: Sep. 27, 1988

[54] ELEVATOR CONTROL APPARATUS

[75] Inventors: Toshisuke Mine; Hideaki Takahashi; Noboru Arabori, all of Katsuta; Katsu Komuro, Mito; Hiromi Inaba, Katsuta, all of Japan

[73] Assignee: Hitachi, Ltd., Tokyo, Japan

[21] Appl. No.: 148,431

[22] Filed: Jan. 26, 1988

[30] Foreign Application Priority Data

Jan. 28, 1987 [JP] Japan ..... 62-16107

[51] Int. Cl.[4] ..... B66B 1/30

[52] U.S. Cl. ..... 187/119

[58] Field of Search ..... 187/116, 118, 119; 318/799-801

[56] References Cited

U.S. PATENT DOCUMENTS

| | | | |
|---|---|---|---|
| 4,083,431 | 4/1978 | Oohira et al. | 187/119 |
| 4,485,895 | 12/1984 | Tachino et al. | 187/116 |
| 4,501,343 | 2/1985 | Salihi | 187/119 |
| 4,503,939 | 3/1985 | Lawrence et al. | 187/116 |
| 4,600,088 | 7/1986 | Yonemoto | 187/119 |
| 4,602,701 | 7/1986 | Tanahashi | 187/119 |

*Primary Examiner*—William M. Shoop, Jr.
*Assistant Examiner*—W. E. Duncanson, Jr.
*Attorney, Agent, or Firm*—Antonelli, Terry & Wands

[57] ABSTRACT

An inverter, which supplies an induction motor for driving an elevator with DC power, is controlled by means of a vector control method. A rotating angular speed of the induction motor is detected from a torque component of a detected motor current. A present position of an elevator cage is calculated on the basis of the detected rotating angular speed.

4 Claims, 9 Drawing Sheets

CONTROL OPERATION TASK

FLOOR HEIGHT MEASURING TASK

NORMAL TRAVELING ROUTINE $V_{TOP}$ CALCULATING TASK

DISTANCE CALCULATING TASK

FLOOR HEIGHT
CORRECTING TASK

SPEED COMMAND GENERATING TASK

ELEVATOR CONTROL APPARATUS

BACKGROUND OF THE INVENTION

1. Field of the invention

The present invention relates to a control apparatus for an inverter-driven elevator, more particularly to an elevator control apparatus having an improved function for detecting a present position of a cage of the elevator.

2. Description of the related art

In an elevator control, it is one of the important factors that a cage of an elevator can land at the level of a floor accurately, and therefore a great concern has been paid about raising the landing accuracy as much as possible.

For this purpose, the speed of the cage is necessary to be controlled accurately. Particularly the high accuracy is required in the speed control during the deceleration of an elevator cage. In order to meet this, an inverter, which is controlled in accordance with a so-called vector control, has been used to control an induction motor for driving an elevator cage, because the vector control can achieve the accurate control of the speed of the induction motor.

Even with the vector control, however, it was still necessary to accurately detect the speed of a cage. Therefore, as disclosed, for example, in U.S. Pat. No. 4,600,088 (issued July 15, 1986), an expensive detector such as a rotary encoder has been employed in order to detect the speed of a motor or the present position of an elevator cage accurately.

SUMMARY OF THE INVENTION

An object of the present invention is to provide an elevator control apparatus, in which a position of an elevator cage is easily detected without using an expensive position detector such as an rotary encoder.

A feature of the present invention resides in the following. An elevator control apparatus according to the present invention has an inverter-driven induction motor. An inverter for driving the induction motor is controlled by means of a vector control method, in which a detected current of the induction motor is decomposed into an excitation component and a torque component. A rotating angular speed of the induction motor is detected from the torque component and a present position of the cage is calculated on the basis of the detected rotating angular speed of the induction motor.

According to the present invention, since a present position of an elevator cage is detected from one of the control amounts created in the process of the signal processing for the vector control. Therefore, any position detector such as an expensive rotary encoder is not needed in the present invention.

DESCRIPTION OF THE PREFERRED EMBODIMENTS

Figure 1:
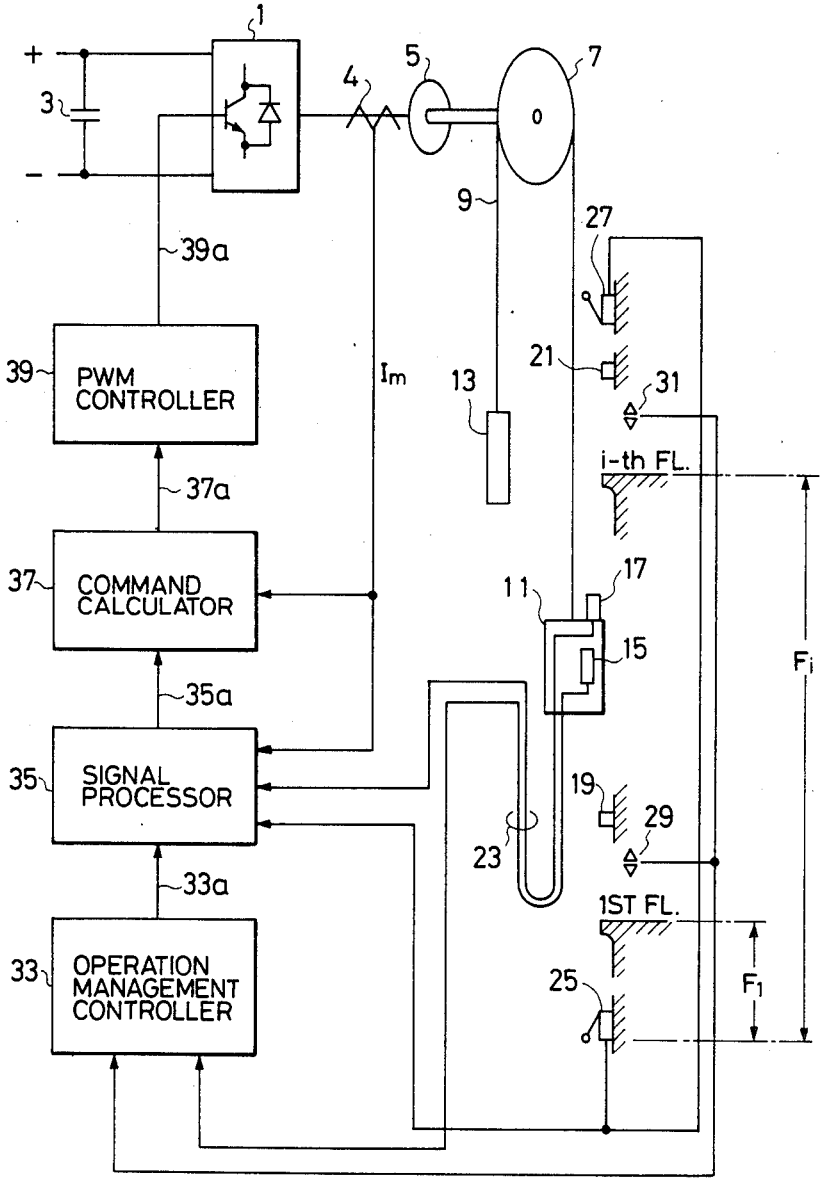
FIG. 1 is a drawing schematically showing an overall construction of an elevator control apparatus according to an embodiment of the present invention.

Referring to the drawings, an embodiment of the present invention will be explained hereinafter.

In FIG. 1 there is shown an overall construction of an elevator control apparatus in accordance with an embodiment of the present invention. An appropriate power source feeds an inverter 1 with DC electric power. A smoothing capacitor 3 is provided across input terminals of the inverter 1. In the figure, the inverter 1 is shown as a so-called voltage source inverter, however there is no limitation in the type of an inverter used in the present invention. A current source inverter can be also employed.

The inverter 1 is operated by means of a pulse width modulation (PWM) control method to invert DC power into three phase AC power. The converted AC power is supplied for a three phase induction motor 5 for driving an elevator cage. Further, the voltage of the AC power is controlled on the basis of a vector control method.

There is provided a current detector 4 between the inverter 1 and the motor 5 in order to detect a motor current $I_m$. Actually, currents $I_u$, $I_v$ and $I_w$ of three phases U, V and W are detected, although, in the figure, a single current detector is shown and the detected currents are represented by $I_m$.

The torque produced by the motor 5 is transmitted to a traction machine 7 through an appropriate reduction mechanism (not shown). The traction machine 7 drives a main rope 9, one end of which is coupled with a cage 11 and the other end with a counterweight 13, whereby the cage 11 travels up and down within an elevator shaft to serve a plurality of floors.

The cage 11 is equipped with a cage operating panel 15, which generates a cage call signal, when a passenger manipulates it. The cage 11 is further provided with a floor detector 17 and, on the other hand, metal plates 19, 21 are installed in the elevator shaft at such positions as the detector 17 faces them when the cage 11 lands at the respective floors accurately. The floor detector 17 produces an output signal, when it faces the metal plates 19, 21. Therefore, the output signal of the detector 17 is generated, every time the cage 11 passes a floor.

The output signal of the floor detector 17 will be called a position interrupt signal in the following description. The cage call signal and the position interrupt signal are transmitted to a control system as described later through a traveling cable 23.

In the elevator shaft, there are further provided a downward limit switch 25 and an upward limit switch 27, which operate to produce output signals when the cage 11 travels down to a downward limit position or up to an upward limit position, respectively, whereby the overrun traveling of the cage 11 is prevented. In elevator halls of the respective floors, there are installed hall button switches 29, 31, which are maniuplated by users and produce hall call signals for requesting the service of the cage 11.

Further, in the following description, the distance measured from the operating position of the downward limit switch 25 to the floor surface of the respective floors will be called a floor height and represented by $F_1, F_2, \ldots, F_i$, as shown in the figure.

The cage call signal and the hall call signal as mentioned above are taken into an operation management controller 33, which totally manages the service operation of the elevator in response to the cage call signals and the hall call signals. The principal operation of the controller 33 is to generate a traveling command 33*a*, including information of a present floor and a destination floor, to a signal processor 35. Since various types of controllers are well known as an operation management controller and the present invention has nothing to do with the type thereof, the further description of this controller 33 is omitted. Further, an instruction for carrying out a floor height measuring operation as described later is generated by an operator or a maintenance personnel through the controller 33.

The signal processor 35 is formed by a microcomputer which executes a desired signal processing on the basis of the traveling command 33*a* from the controller 33, the position interrupt signal from the detector 17, the signals from the downward and upward limit switches 25, 27 and the motor current $I_m$ detected by the current detector 4. The signal processing by the microcomputer will be discussed in detail, referring to FIG. 2 et seq. As the result of the signal processing, the processor 35 produces an output signal 35*a* to a control command calculator 37. Further, the microcomputer has an appropriate storage, in which various work tables are defined. Details of the work tables will be explained later.

The calculator 37 at first calculates a reference of the motor current on the basis of the signal 35*a*. The calculated reference is compared with the detected current $I_m$ so that the deviation therebetween is obtained. A control signal (a modulating signal for the PWM control) 37*a* is obtained on the basis of the deviation. In a PWM controller 39, as is well known, a triangular carrier wave is generated, which is compared with the signal 37*a* so that gate signals 39*a* for the inverter 1 are generated. As a result, the inverter 1 is operated by the gate signals 39*a* on the PWM control base.

Figure 2:
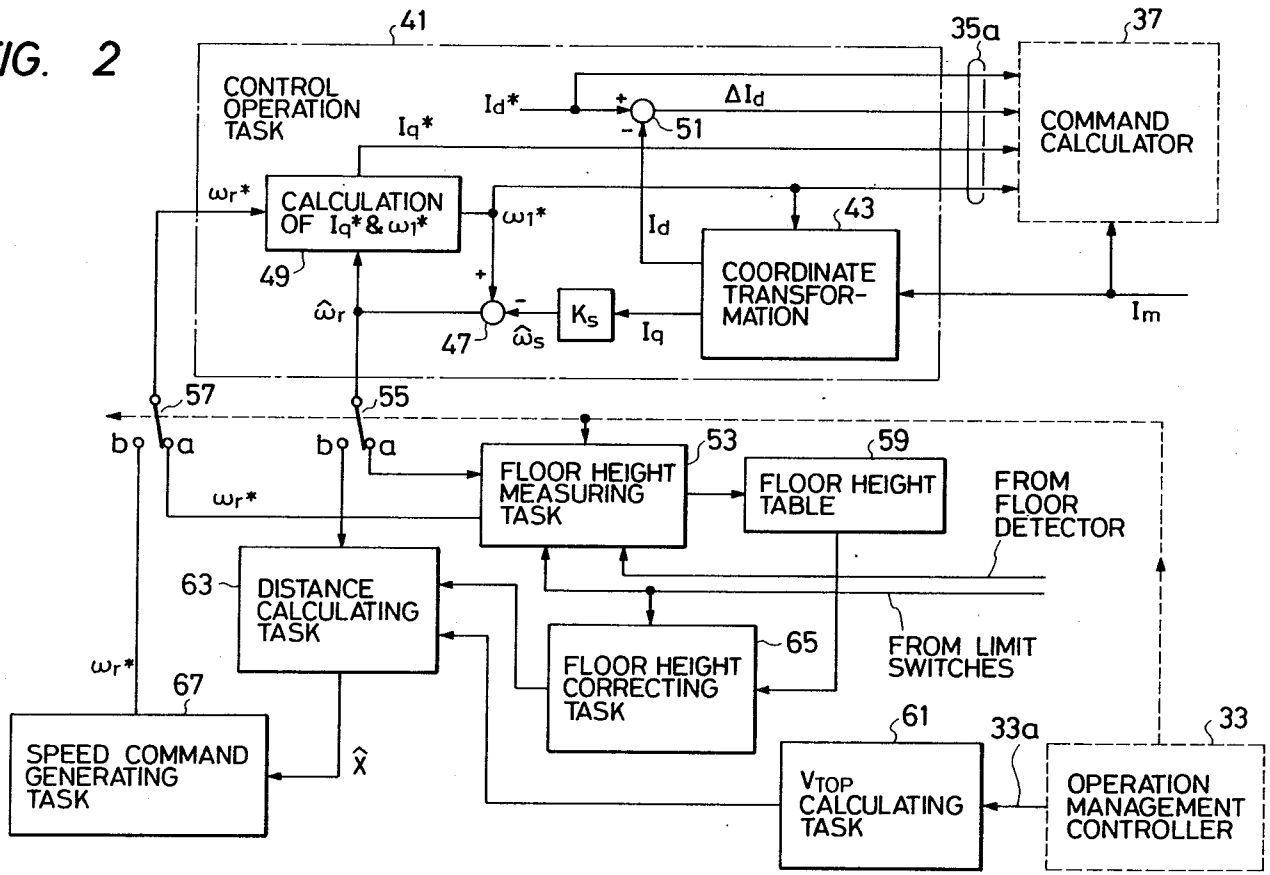
FIG. 2 is a functional block diagram for explaining the function of a signal processor included in the control apparatus of FIG. 1.

Referring next to FIG. 2, the signal processor 35 will be explained in detail. As already described, the signal processing in the processor 35 is performed by the microcomputer programed to execute various tasks necessary for completing the desired signal processing.

Before the detailed explanation of the signal processing in the processor 35, the description will be made of the work tables, which occupy the predetermined areas within the storage of the microcomputer and hold various variables.

(1) Work table for data concerning the floor control (called a floor control work table, hereinafter):

N a destination floor;

n a present floor;

$F_1, F_2, \ldots, F_i$ value of a floor height of 1st, 2nd, . . . , i-th floor (cf. FIG. 1);

$\Delta X_{Nn}$ a distance between the present floor and the destination floor;

$\Delta Y_m$ a minimum distance necessary for a cage to travel at speed $V_m$;

$\Delta\hat{\theta}_r$ a rotating angle of a motor for driving the cage;

$\Delta\hat{X}$ a cage traveling distance for $\Delta\hat{\theta}_r$; and $\Delta\hat{X}$ a distance of a present position of the cage, measured from a downward limit switch.

(2) Work table for the motor control operation (called a motor control work table, hereinafter):

$\omega_r^*$ a command for a rotating angular speed of the motor;

$\omega_1^*$ a command for frequencies of a primary voltage applied to the motor;

$I_q^*$ a command for a torque component of a motor current;

$I_d^*$ a command for an excitation component of the motor current;

$I_q$ a torque current component of a detected motor current;

$I_d$ an excitation component of the detected motor current;

$\hat{\omega}_s$ a slip of the motor in terms of a rotating angular speed;

$\hat{\omega}_r$ a rotating angular speed of the motor; and $I_m$ a detected value of the motor current.

(3) Work table for the speed command generation (called a speed command work table, hereinafter):

m a notch for the speed control;

$V_{TOP}$ a normal traveling speed of the cage;

$V^*$ a speed command for the cage;

MOD a mode of traveling of the cage;

$t_\alpha$ time for an acceleration of the cage; and $t_\beta$ time for a deceleration of the cage.

(4) Table for specific data (called a specific data table, hereinafter):

$\alpha$ acceleration;

$\beta$ deceleration;

$V_1, V_2, \ldots, V_m$ traveling speed at 1st, 2nd, . . . , m-th notch;

$V_{max}$ a maximum allowable speed of the cage;

$K_d$ a gain for converting the rotating angle $\Delta\hat{\theta}_r$ into the cage traveling distance $\Delta\hat{X}$;

$K_s$ a gain for converting the torque component $I_q$ of the motor current into the slip angular speed $\hat{\omega}_s$; and $K\omega$ a gain for converting the speed command $V^*$ (or the aforesaid traveling speed $V_1, V_2, \ldots, V_m$) into the command $\omega_r^*$ for the rotating angular speed of the motor.

In the operation described below, detected or calculated values of the variables are stored in corresponding areas of these work tables and necessary data is read out therefrom. Further, symbols of the variables listed above will be also used as reference symbols representing signals of the respective variables or their amount.

Now, there is shown in FIG. 2 the function of the processor 35 in the form of a block diagram, for easy understanding. Therefore, the block diagram of FIG. 2 may be shown in a somewhat different manner from the actual operation carried out by the microcomputer of the signal processor 35.

The signal processing of the processor 35 includes a control operation task 41, which is surrounded by a chain line. Briefly, the task 41 receives the rotating angular speed command $\omega_r^*$ and the detected motor current $I_m$ and executes the signal processing necessary for the vector control on the basis of the received signals to produce the output signal 35*a*.

Although details will be described later, the output signal 35*a* is composed of the command $I_d^*$ for the excitation component of the motor current, a deviation $\Delta Id$ between the command $I_d^*$ and its actual value $I_d$, which is obtained by the calculation as described later, the command $I_q^*$ for the torque component of the motor current, and the command $\omega_1^*$ for the frequencies of the primary voltage applied to the motor 5.

The control operation task 41 carries out a coordination transformation 43 with respect to the received motor current $I_m$ in accordance with the following relationship. Further it is to be noted here that the motor current $I_m$ represents the currents $I_u$, $I_v$ and $I_w$ of the three phases.

$$I_d = i_\alpha \cos\phi + i_\beta \sin\phi \quad (1)$$

$$I_q = i_\beta \cos\phi - i_\alpha \sin\phi \quad (2)$$

wherein $$i\alpha = I_u - \frac{1}{2} I_v - \frac{1}{2} I_w \quad (3)$$

$$i\beta = \frac{\sqrt{3}}{2} (I_v - I_w) \quad (4)$$

$$\phi = \omega_1^* t + \rho \quad (5)$$

$\sigma$ is a constant determined by a phase of the motor current $I_m$.

The thus obtained torque component $I_q$ is multiplied by the gain $K_s$ and converted into the angular speed $\hat{\omega}_s$ of the slip of the motor 5. Thereafter, the subtraction 47 is carried out between the slip angular speed $\hat{\omega}_s$ and the frequency command $\omega_1^*$ so that the rotating angular speed $\hat{\omega}_r$ of the motor 5 is obtained.

Next, the calculation 49 of the command $I_q^*$ for the torque component and the frequency command $\omega_1^*$ is executed on the basis of the rotating angular speed $\hat{\omega}_r$ obtained as above and the command $\omega_1^*$ thereof, as follows. Further, $\omega_1^*$ will be discussed in detail later.

$$I_q^* = k_1(\omega_r^* - \hat{\omega}_r) \quad (6)$$

$$\omega_1^* = \hat{\omega}_r + k_2(\omega_r^* - \hat{\omega}_r) \quad (7)$$

Among the two commands calculated as above, the command $I_q^*$ for the torque component is directly coupled with the command calculator 37. The frequency command $\omega_1^*$ is used in the coordinate transformation 43 and the subtraction 47 and further coupled with the command calculator 37.

The command $I_d^*$ is set at a rated value of an excitation current of the motor 5. A rated excitation current is specific to an induction motor used. In order to control the excitation component of the motor current $I_m$ constant, the comparison 51 is carried out between the excitation component $I_d$ of the detected current $I_m$ and the command $I_d^*$ thereof so that the deviation $\Delta I_d$ is obtained.

The command calculator 37 receives the commands $I_d^*$, $I_q^*$ and $\omega_1^*$ and the deviation $\Delta I_d$ as mentioned above and obtains the current command by the following calculation.

$$\sqrt{(I_d^* + \Delta I_d)^2 + I_q^{*2}} \sin(\omega_1^* t + \eta) \quad (8)$$

wherein $$\eta = \tan^{-1} \frac{I_q^*}{I_d^* + I_d} \quad (9)$$

The signal processing further comprises a floor height measuring task 53, which measures the floor height of the respective floors from the operating position of the downward limit switch 25 during the preparatory operation taking place after installation of the elevator or when the renewal of the data of the floor height becomes necessary.

The task 53 is initiated by a signal as shown by a broken line, which is given by an operator or a maintenance personnel through the operation management controller 33. Further, the signal from the controller 33 actuates switches 55, 57 to throw them into side a, as shown in the figure. Thereby, the task 53 provides the command $\omega_r^*$ for the duration of the preparatory operation through the switch 57, and on the other hand, it also calculates the floor height on the basis of the rotating angular speed $\hat{\omega}_r$ provided by the control operation task 41. The thus measured floor height is stored in a floor height table 59 defined in the storage of the microcomputer.

During a normal operation of the elevator, the operation management controller 33 throws the switches 55, 57 into side b and produces the traveling command 33*a* in response to the cage call signals and the hall call signals. The traveling command 33*a* initiates a normal traveling routine. In this routine, a $V_{TOP}$ calculated task 61 is at first executed to determine a normal traveling speed $V_{TOP}$. The normal traveling speed $V_{TOP}$ depends on the distance between the present floor and the destination floor where the cage 11 should stop next.

When the cage 11 starts to travel, a distance calculating task 63 is initiated by a signal from the task 61 and continues to calculate the cage position $\hat{X}$ on the basis of the angular speed $\omega_r$ given from the control operation task 41 through the switch 55. In the execution of the task 63, a signal concerning the floor height from a floor height correcting task 65 is used. The task 65 reads out the data of the floor height from the table 59 in synchronism with the position interrupt signal from the floor detector 17 and conveys it to the task 63 as the signal representing the present position of the cage 11.

A speed command generating task 67 generates the speed command $V^*$ on the basis of the cage position $\hat{X}$. The calculated speed command $V^*$ is converted into the command $\omega_r^*$ for the rotating angular speed of the motor 5. The thus obtained command $\omega_r^*$ is coupled to the control operation task 41 through the switch 57.

As described above, according to the present invention, the cage position $\hat{X}$ is detected by the calculation which is carried out on the basis of the rotating angular speed $\hat{\omega}_r$ of the motor 5, which is one of the control amounts created in the process of the signal processing for the vector control of the motor 5. Therefore, any expensive detector, such as a rotary encoder, is not needed in order to detect the position of the cage 11.

Referring now to flow charts shown in FIG. 3 et seqq., the operation of the signal processor 35 will be explained in detail hereinafter. The explanation will be separately made of a floor height measuring routine executed in the preparatory operation and a normal traveling routine executed in the normal service operation.

Figure 3:
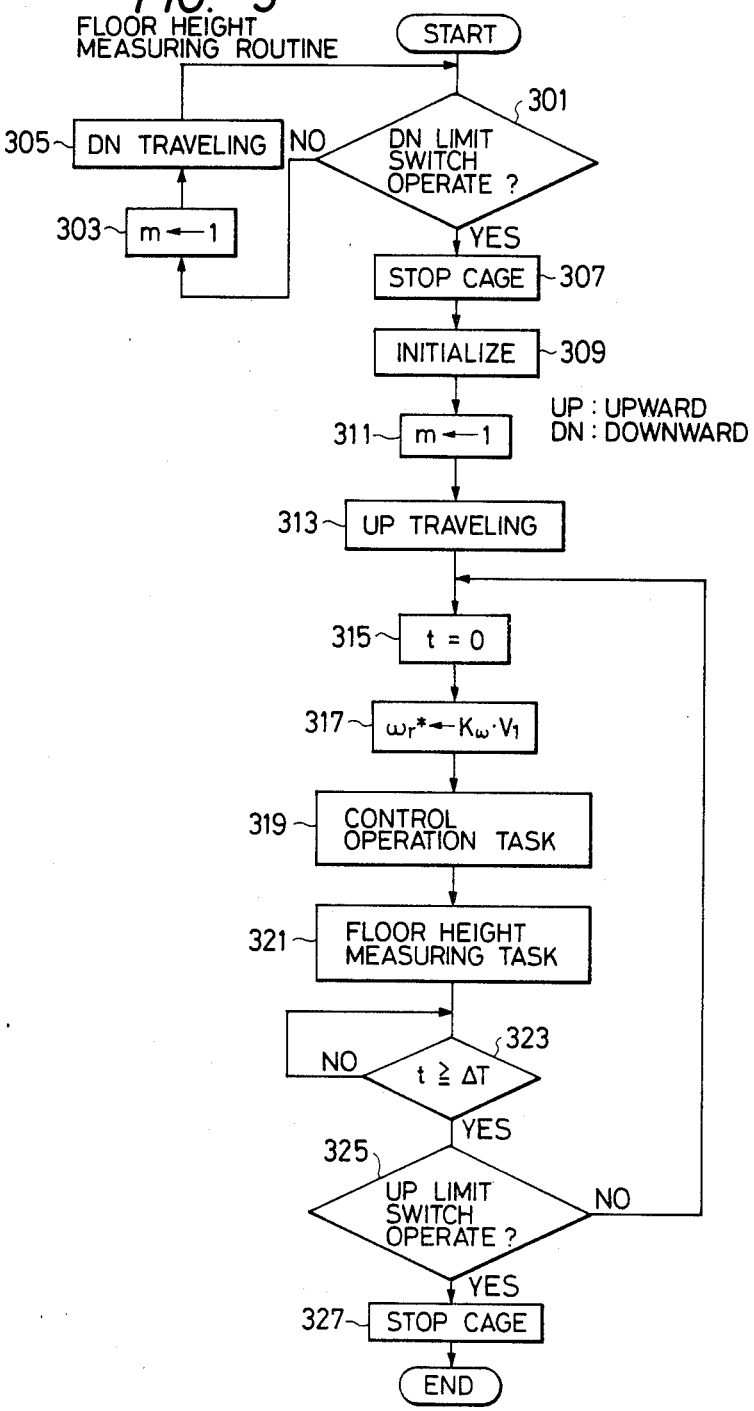
FIG. 3 is a flow chart of a floor height measuring routine, which is executed by the signal processor in FIG. 1 during a preparatory operation of an elevator.

In FIG. 3 there is shown a flow chart of the floor height measuring routine. As already described, this routine is carried out in order to detect the floor height by the preparatory operation, for example, after installation of an elevator. If an operator or a maintenance personnel gives an instruction to the control apparatus through the operation management controller 33, the switches 55, 57 are thrown into side a and the floor height measuring routine is started.

At first, at step 301, it is judged whether or not the cage 11 is at a standard position, i.e., whether or not the downward limit switch 25 is operated. If it is not at the position, an area m for the speed control notch in the speed command work table is set at one (step 303) and the downward traveling is instructed (step 305). Thereby, the cage 11 travels downward until the downward limit switch 25 is operated. The traveling speed by the first notch is 15 m/sec, for example, so that the cage 11 continues to travel slowly and stops when the downward limit switch 25 is operated (step 307).

When the cage 11 stops, the floor height table 59 and the work tables, except the specific data table, are initialized (step 309). Thereafter, the area m for the speed control notch in the speed command work table is set at one again (step 311) and the upward traveling is instructed (step 313), whereby the cage 11 begins the upward traveling for the purpose of the floor height measuring.

At the same time as the departure of the cage 11 from the standard position, a timer is set and starts to count time (step 315). Then, at step 317, the speed $V_1$ of the first notch is converted into the command $\omega_r^*$ for the rotating angular speed of the motor 5. The gain $K_\omega$ employed in this conversion is stored in a predetermined area of the specific data table.

Figure 4:
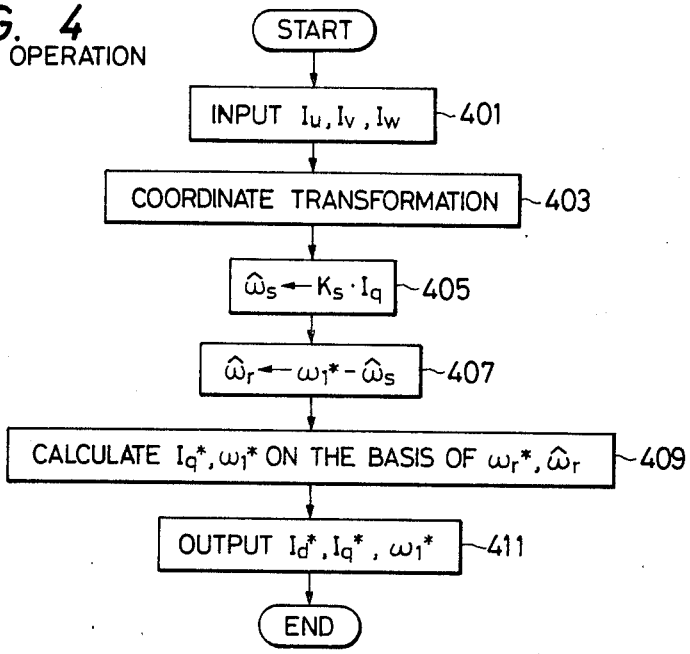
FIG. 4 is a flow chart showing details of a control operation task included in the routine of FIG. 3.

Thereafter, at step 319, the control operation task 41 is carried out. A flow chart of the task 41 is shown in FIG. 4. At first, the motor currents $I_u$, $I_v$, $I_w$ are taken into predetermined areas in the motor control work table (step 401). Then, at step 403, the motor currents $I_u$, $I_v$, $I_w$ are subject to the coordinate transformation as already described and converted into the excitation component $I_d$ and the torque current component $I_q$. The thus obtained $I_d$ and $I_q$ are stored in the respective areas of the motor control work table.

Figure 6:
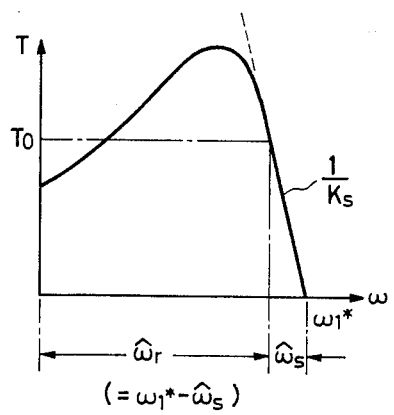
FIG. 6 is a drawing for explaining the relationship between a torque produced by an induction motor and a rotating angular an speed of the motor.

The excitation component $I_d$ stored in the work table is used for controlling the excitation component of the motor current $I_m$ constant. On the other hand, the torque component $I_q$ is converted into the slip angular speed $\hat{\omega}_s$ at step 405. As apparent from FIG. 6, in which there is shown the characteristic of torque versus slip angular speed of an induction motor, the conversion of $I_q$ into $\hat{\omega}_s$ can be carried out by the relationship of $K_s.I_q$, because the torque is proportional to $I_q$, and $I_q$ and are in the linear relationship. The gain $K_s$ is specific to an induction motor used and therefore is stored in advance in a predetermined area of the specific data table.

The thus obtained $\hat{\omega}_s$ is stored in an area defined for $\hat{\omega}_s$ in the motor control work table. Then, at step 407, the subtraction is carried out between the obtained slip angular speed $\hat{\omega}_s$ and the frequency command $\omega_1^*$, which is read out from a predetermined area of the motor control work table. The rotating angular speed $\hat{\omega}_r$ obtained as above is stored in a predetermined area of the motor control work table.

At step 409, the commands $I_q^*$ and $\omega_1^*$ are calculated in accordance with the already described relationship on the basis of the above obtained $\hat{\omega}_r$ and the command $\omega_r^*$. The command $\omega_r^*$, which is obtained at step 317, is sored in the motor control work table and read out therefrom for execution of step 409. At step 411, the thus obtained $I_q^*$ and $\omega_1^*$ are output to the command calculator 37, together with $I_d^*$, which is set in advance in the motor control work table. When these commands are output, the control operation task 41 is completed and the operation is returned to a main routine of FIG. 3.

Figure 5:
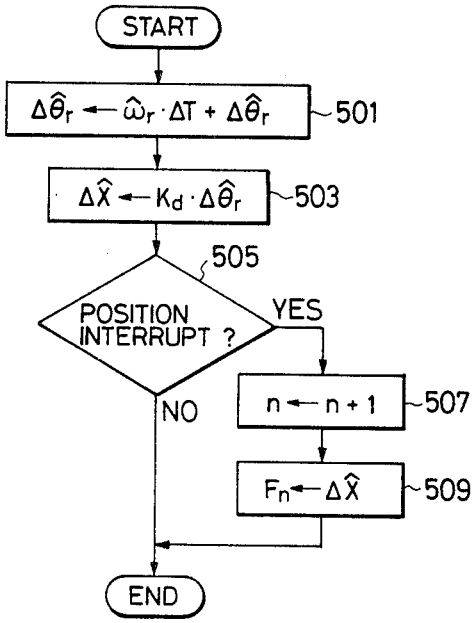
FIG. 5 is a flow chart showing details of a floor height measuring task included in the routine of FIG. 3.

In the main routine, the operation goes to step 321, at which the floor height measuring task 53 is executed. The task 53 is a task for calculating the traveling distance $\hat{X}$ of the cage 11 and determining the floor height measured from the operating position of the downward limit switch 25. A flow chart of this task is shown in FIG. 5. Before the description of the flow chart, the algorithm of this task will be explained, referring to FIG. 7.

In the figure, the same reference numerals denote the same parts as in FIG. 1. As shown in the figure, the reduction mechanism, which has been omitted in FIG. 1, comprises a first gear 8 of a diameter $D_1$ coupled to the motor 5 and a second gear of a diameter $D_2$ coupled to the traction machine 7. Further, a diameter of the traction machine 7 is $D_s$.

Figure 7:
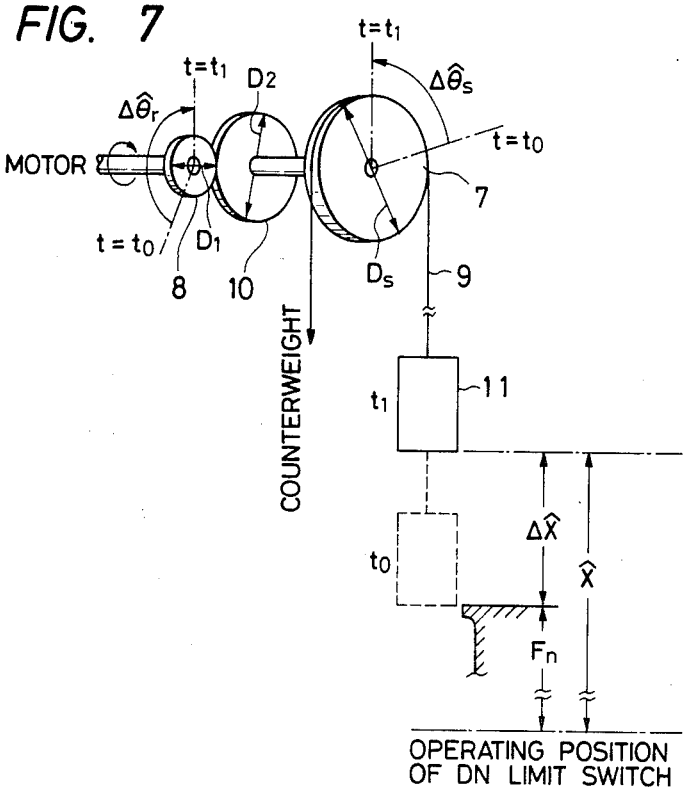
FIG. 7 is a drawing for explaining the relationship between a rotating angle of the motor and a traveling distance of an elevator cage.

As apparent from FIG. 7, there exist the following relationships in the rotating angle $\Delta\hat{\theta}_r$ of the motor 5 and the traveling distance $\hat{X}$ of the cage 11, with respect to the duration from time point $t_0$ to time point $t_1$.

$$\Delta\Theta_r = \int_{t_0}^{t_1} \omega_r dt \tag{10}$$

$$\Delta\hat{X} = \frac{D_1}{D_2} \cdot D_s \cdot \Delta\hat{\Theta}_r \tag{11}$$

The first formula is changed in a discrete manner, as follows.

$$\Delta\hat{\Theta}_{r,j} = \sum_{j=1}^{j_0} (\hat{\omega}_{r,j} \cdot \Delta T) \tag{12}$$

wherein $\Delta T$: sampling period, $\omega_{r,j}$: the value of $\omega_R$ at time point $(t_0+\Delta T \cdot j)$, and $j_0$: $(t_1-t_0)/\Delta T$ Accordingly, both the formulas (10) and (12) are expressed as follows.

$$\Delta\hat{\theta}_{r,j}=\hat{\omega}_{r,j}\cdot\Delta T+\Delta\hat{\theta}_{r,j-1} \tag{13}$$

$$\Delta\hat{X}=K_d\cdot\Delta\hat{\theta}_{r,j} \tag{14}$$

In the formula (14), $K_d$ is represented by $(D_1/D_2)D_s$. This value is specific an elevator, and therefore it is stored in a predetermined area of the specific data table in advance.

Referring now to FIG. 5, the flow chart of the task 53 will be explained. At step 501, the rotating angle $\Delta\hat{\theta}_r$ is calculated on the basis of the angular speed $\hat{\omega}_r$ and the previous value of the rotating angle $\Delta\hat{\theta}_r$ (initially, $\Delta\hat{\theta}_r=0$). Although, as described above, $\Delta T$ represents the sampling period, it also means a time interval of the repetition of this calculation, which is generally set at a time smaller than a time constant in the response of the speed control of the elevator, e.g. about ten millisecond.

Further, $\hat{\omega}_r$ is read out from a predetermined area in the motor control work table and $\Delta\hat{\theta}_r$ from a predetermined area in the floor control work table. The thus obtained rotating angle $\Delta\hat{\theta}_r$ of the motor 5 is stored again in the corresponding area of the floor control work table, i.e., the content of the corresponding area is renewed by the newly calculated $\Delta\hat{\theta}_r$.

Then, the traveling distance $\Delta\hat{X}$ is calculated for the rotating angle $\Delta\hat{\theta}_r$ at step 503, and the content of the area for $\Delta\hat{X}$ in the floor control work table is renewed by the newly calculated $\Delta\hat{X}$. At step 505, it is discriminated whether or not the position interrupt signal is produced by the floor detector 17.

If there is no position interrupt signal, the operation ends to return to the main routine of FIG. 3. If the position interrupt signal exists, the content of the area n for the present floor in the floor control work table is increased by one and the result thereof is stored in the corresponding area of the floor control work table again (step 507). The value of $\Delta\hat{X}$ calculated at step 503 is stored in a predetermined area of the floor height table 59, which corresponds to n obtained at step 507 (step 509). Thereafter, the operation returns to the main routine of FIG. 3.

Referring again to FIG. 3, after the floor height measuring task 53 is completed at step 321, it is judged at step 323 whether or not time t reaches $\Delta T$. If the time $\Delta T$ does not yet lapse, the judgment operation is repeatedly continued until $\Delta T$ lapses. When time t reaches $\Delta T$, the operation goes to step 325, at which it is judged whether or not the upward limit switch 27 is operated. If the switch 27 is not operated, the operation returns to step 315 and is repeated again in the same manner as described above.

If the upward limit switch 27 operates, this means that the floor height operation is completed until the highest floor. Therefore, the operation of this routine ends after an instruction for stopping the cage 11 is given (step 327).

In this manner, the floor heights of all the floors measured from the operating position of the downward limit switch 25 are detected by repeating the operation from step 315 till step 325 and stored in the floor height table 59.

Figure 8:
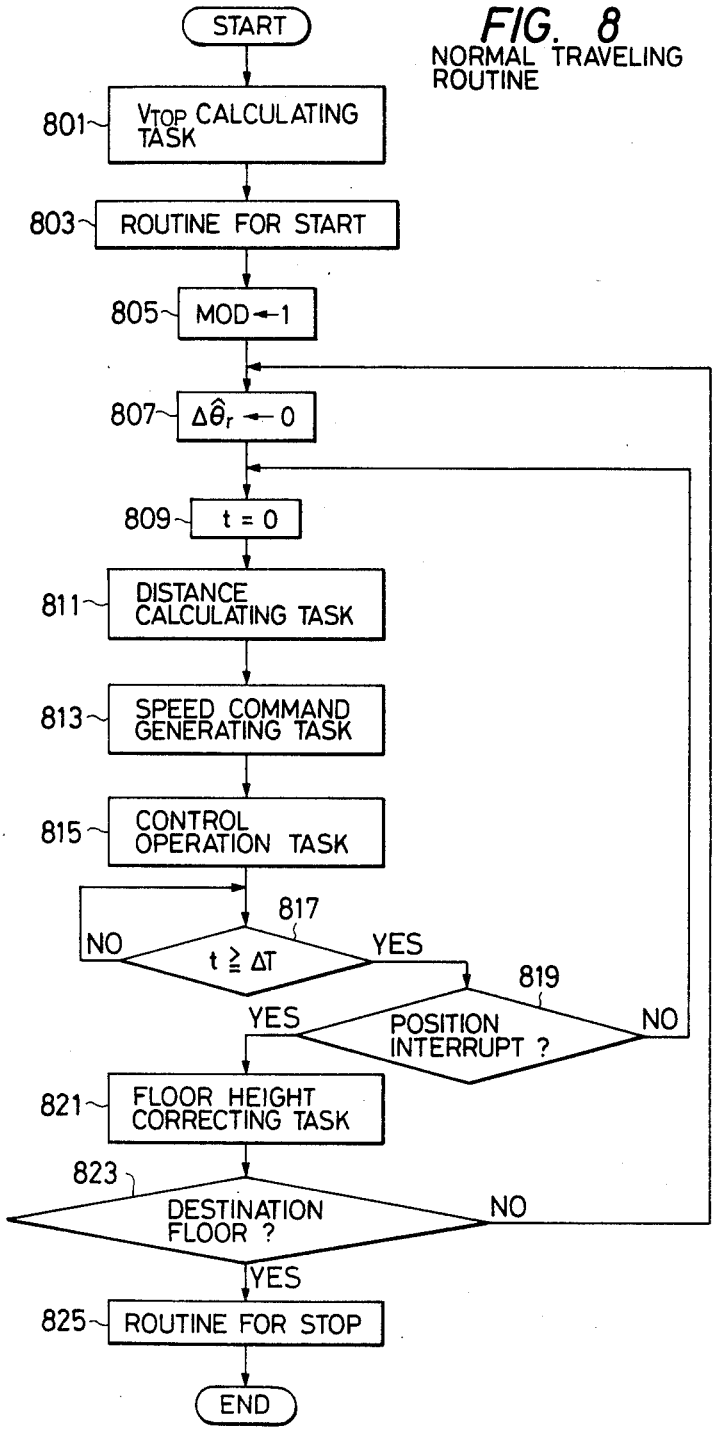
FIG. 8 is a flow chart of a normal traveling routine, which is executed by the signal processor in FIG. 1 during a normal operation for service.

In the following, the explanation will be done of the normal traveling operation. FIG. 8 shows a flow chart of a main routine for the normal traveling operation.

The normal traveling routine is initiated by the traveling command 33*a* from the operation management controller 33. When this routine starts, the $V_{TOP}$ calculating task 61 is at first executed at step 801. A detailed flow chart of the task 61 is shown in FIG. 9.

Figure 9:
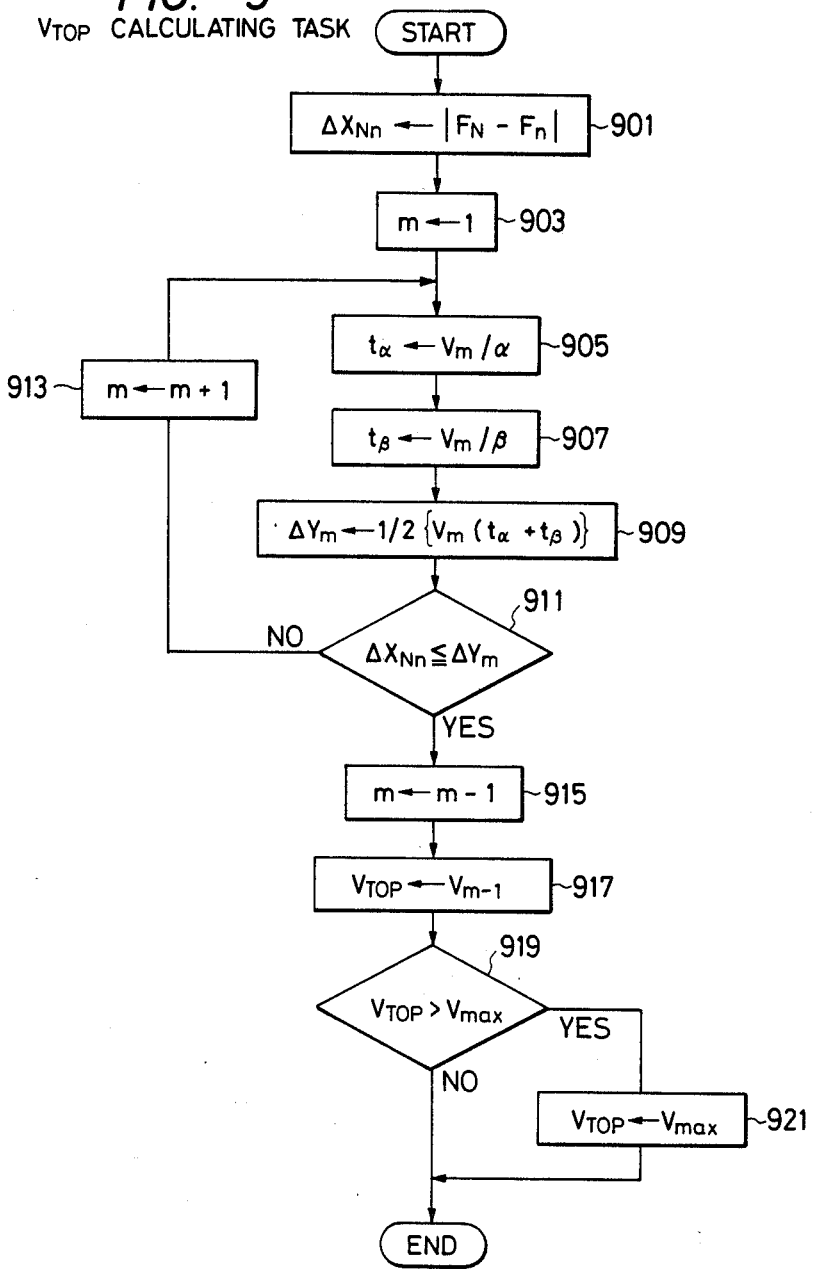
FIG. 9 is a flow chart showing details of a $V_{TOP}$ calculating task included in the normal traveling routine of FIG. 8.

In FIG. 9, at step 901, the distance $\Delta X_{Nn}$ between the present floor n and the destination floor N is calculated on the basis of the floor height values $F_n$ and $F_N$ of the respective floors which are given from the operation management controller 33 together with the traveling command 33*a*. The calculated distance $\Delta X_{Nn}$ is stored in a predetermined area in the floor control work table. At step 903, the first notch is at first selected and stored in a predetermined area in the speed command work table.

Next, the acceleration time $t_\alpha$ is calculated at step 905, and then the deceleration time $t_\beta$ at step 907. The acceleration time $t\alpha$ means a time during which the cage 11 is accelerated with the acceleration $\alpha$ and its speed can be increased up to the speed $V_1$ of the first notch. Similarly, the deceleration time $t\beta$ means a time during which the cage 11 is decelerated with the deceleration $\beta$ and its speed is decreased down to the speed $V_1$ of the first notch. The calculated times $t\alpha$ and $t\beta$ are stored in predetermined areas in the speed command work table.

On the basis of $t\alpha$ and $t\beta$ obtained at these steps, the distance $\Delta Y_1$ is calculated at step 909. The distance $\Delta Y_1$ means a distance in which the cage 11 is accelerated with the acceleration $\alpha$ until its speed reaches $V_1$ and thereafter the cage 11 is decelerated with the deceleration $\beta$ until its speed becomes zero from $V_1$. At step 911, it is judged whether or not the thus obtained distance $\Delta Y_1$ exceeds the distance $\Delta X_{Nn}$ obtained at step 901. If the former is smaller than the latter, notch m is increased by one (step 913) and the operation of step 905 et seq. is carried out again. This loop operation is repeated until $\Delta Y_m$ exceeds $\Delta X_{Nn}$.

The fact that $\Delta Y_m$ has become larger than $\Delta X_{Nn}$ means that the m-th notch, which has been searched for by the loop operation, is by one higher than its appropriate value. Then, at step 915, the value of notch is decreased by one and the notch (m−1) is stored in a predetermined area of the speed command work table. At step 917, the speed $V_{m-1}$ corresponding to the (m−1)th notch is stored in an area for $V_{TOP}$ in the speed command work table.

Then, it is judged at step 919 whether or not $V_{TOP}$ determined as above is larger than the maximum allowable speed $V_{max}$ of the cage 11, which is stored in a predetermined area in the specific data table. If $V_{TOP}$ does not exceed $V_{max}$, that value of $V_{TOP}$ is made the normal traveling speed. If, however, $V_{TOP}$ exceeds $V_{max}$, the latter is used as the normal traveling speed $V_{TOP}$ (step 921).

Returning to FIG. 8, after the $V_{TOP}$ calculating task 61 is completed, the routine for start is executed (step 803). Although details are omitted here, the routine for start is a routine for preparing the start of the cage 11. The principal function of this routine is to release the braking force effected during the stop of the cage 11. In the figure, step 803 is executed after the completion of step 801. However, both steps 801 and 803 can be simultaneously initiated. Namely, $V_{TOP}$ can be calculated, while the start of the cage 11 is being prepared.

Figure 10:
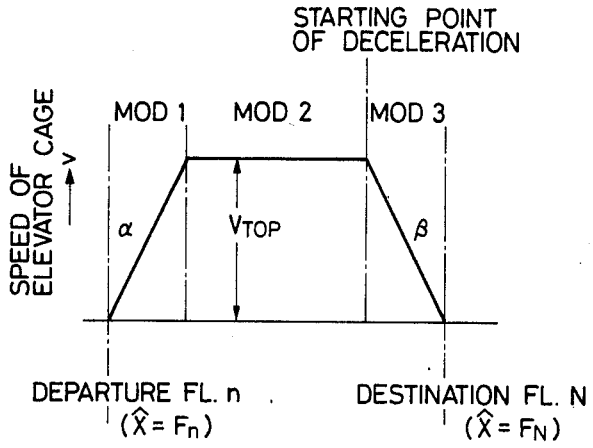
FIG. 10 is a drawing for explaining the generation of a speed pattern and modes of the traveling of an elevator cage.

At step 805, an area MOD for the traveling mode of the cage 11 in the speed command work table is set at one. The traveling mode of the cage 11 will be explained, referring to FIG. 10, in which there is shown an example of a speed pattern. As shown in the figure, MOD=1 means that the cage 11 is being accelerated at the acceleration $\alpha$. Further, MOD=2 means that the cage 11 is traveling at a constant speed $V_{TOP}$ and MOD=3 means that it is being decelerated at the deceleration $\beta$.

Figure 11:
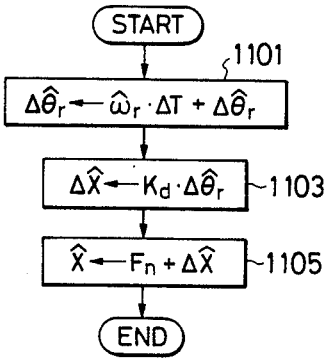
FIG. 11 is a flow chart showing details of a distance calculating task included in the normal traveling routine of FIG. 8.

At step 807, the area of $\Delta\hat{\theta}_r$ in the floor control work table is cleared, and then, at step 809, the timer is set at zero and begins to count time. At step 811, the distance calculating task 63 is initiated. As shown in FIG. 11, the task 63 is the same in the principal portion as the floor height measuring task 53 already described. Therefore, the task 63 will be discussed briefly.

In FIG. 11, at step 1101, the rotating angle $\Delta\hat{\theta}_r$ is calculated on the basis of the angular speed $\hat{\omega}_r$ and the previous value of the rotating angle $\Delta\hat{\theta}_r$. The time $\Delta T$ in this step is the same as in step 501 of FIG. 5. Further, $\hat{\omega}_r$ is read out from the predetermined area in the motor control work table and $\Delta\hat{\theta}_r$ from the predetermined area in the floor control work table.

The thus obtained rotating angle $\Delta\hat{\theta}_r$ of the motor 5 is stored again in the corresponding area of the floor control work table, i.e., the content of the corresponding area is renewed by the newly calculated $\Delta\hat{\theta}_r$. Then, at step 1103, the traveling distance $\Delta\hat{X}$ is calculated for the rotating angle $\Delta\hat{\theta}_r$ obtained at the previous step, and the content of the area for $\Delta\hat{X}$ in the floor control work table is renewed by the newly calculated $\Delta\hat{X}$.

Although details will be apparent later, the distance calculating task 63 is repeatedly executed every time the position interrupt signal occurs. Further, as indicated in step 807, the rotating angle $\Delta\hat{\theta}_r$ is cleared every time this task is initiated. Therefore, the traveling distance $\Delta\hat{X}$ means a traveling distance of the cage 11 measured from the floor through which the cage 11 has passed just before. Then, at step 1105, the above obtained $\Delta\hat{X}$ is added to the value $F_n$ of the floor height of the just previous floor, so that the distance $\hat{X}$ of the present cage position measured from the operating position of the downward limit switch 25 is obtained. The thus obtained $\hat{X}$ is stored in a predetermined area of the floor control work table.

After the distance calculating task 63 is completed, the operation returns to the main routine of FIG. 8, and at step 813, the speed command generating task 67 is initiated. A flow chart of this task 67 will be discussed, referring to FIG. 12.

Figure 12:
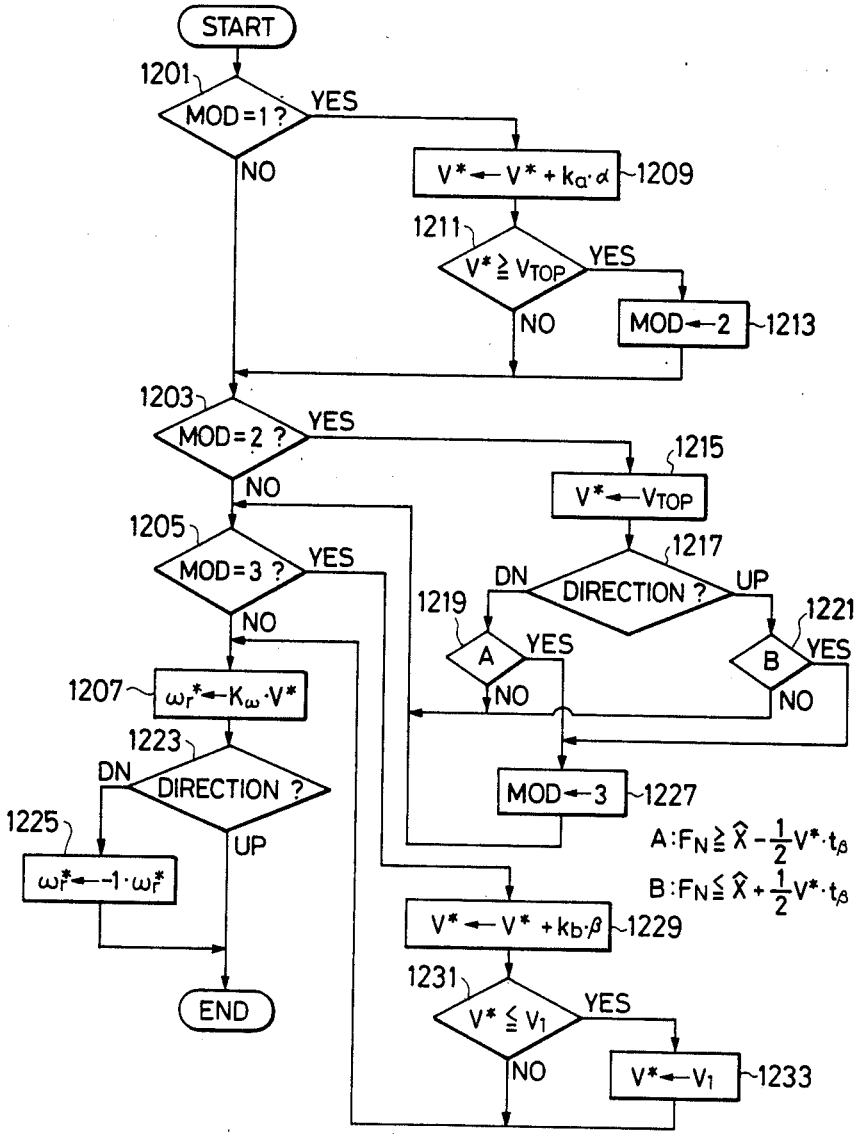
FIG. 12 is a flow chart showing details of a speed command generating task included in the normal traveling routine of FIG. 8.

In FIG. 12, at step 1201, it is judged whether or not the value of the traveling mode of the cage 11 is one. If the answer in this step is NO, it means that the cage 11 stops at a certain floor or the value of the traveling mode is either two or three. Then, the operation goes to step 1203, at which it is further judged whether or not the value of the traveling mode is two.

If the answer in step 1203 is also NO, it means that the cage 11 stops at a certain floor or the value of the traveling mode is three. Then, the operation goes to step 1205, at which it is judged whether or not the value of the traveling mode is three. If the answer in this step is again NO, it means that the cage 11 stops at a certain floor. Accordingly, since no speed command V* is produced hitherto, step 1207 is not carried out. As a result, the execution of this task 67 ends and the operation returns to the main routine of FIG. 8. Further, a flow in step 1207 et seq. represents the operation, by which the speed command V* is converted into the command $\omega_r$* for the rotating angular speed in accordance with the traveling direction of the cage 11. The gain $K_\omega$ used in this conversion is stored in the predetermined area in the specific data table.

Returning to step 1201, if the answer in this step is YES, the operation goes to step 1209. As will be apparent from the description later, this task 67 is repeated every $\Delta T$, and hence step 1209 is repeatedly executed at intervals of $\Delta T$. Thereafter, at step 1209, the speed command V* is calculated on the basis of the acceleration $\alpha$ and the speed command V*, which was calculated last time of the repetitive operation (i.e., $\Delta T$ before). Further, $k_a$ is a constant for converting the acceleration $\alpha$ into a speed which is attained by the acceleration $\alpha$ during $\Delta T$. Accordingly, step 1209 produces the speed command V* with respect to time, as this task 67 is repeated every $\Delta T$.

Then, at step 1211, it is discriminated whether or not V* is equal to or larger than $V_{TOP}$, which has been already determined by execution of the $V_{TOP}$ calculating task 61. If V* exceeds $V_{TOP}$, it means that a point of changing the traveling mode is reached (cf. FIG. 10). Therefore, the area of MOD in the speed command work table is renewed by two (step 1213), and thereafter the operation goes to step 1203.

If V* is smaller than $V_{TOP}$, it means that the traveling mode still remains at one. Therefore, the answers in the judgment at steps 1203 and 1205 are NO. In this case, however, the speed command V* produced at step 1209 is converted into the command $\omega_r$* of the rotating angular speed at step 1207.

When MOD is judged to be two at step 1203, the operation goes to step 1215, at which $V_{TOP}$ obtained by the $V_{TOP}$ calculating task 61 is stored in the area for V* in the speed command work table. Then, the starting point of deceleration (cf. FIG. 10) is determined in accordance with the direction of the traveling of the cage 11. The traveling direction of the cage 11 is discriminated at step 1217.

If the cage 11 travels downward, the following discrimination is carried out at step 1219. At first, a distance necessary for decelerating and stopping the cage 11, which travels at the speed V*, at the deceleration $\beta$ is calculated by the relationship of $V^*t\beta/2$. Then, the thus obtained distance is subtracted from the distance X of the present position of the cage 11. If the answer in step 1219 is NO, i.e., when the result of the subtraction is larger than the floor height value $F_N$ of the destination floor, the operation goes to step 1205, because the cage 11 does not yet reach the starting point of deceleration.

Since the position of the cage 11 does not reach the starting point of deceleration, the value of MOD remains at two. Therefore the answer of step 1205 becomes NO and the operation goes to step 1207, at which the speed command V* set at step 1215 is converted into the command $\omega_r$* for the rotating angular speed of the motor 5. Then, at step 1223, the traveling direction of the cage 11 is discriminated. If the cage 11 travels upward, $\omega_r$* obtained at step 1207 is utilized as the command, as it is, and if the cage 11 travels downward, $\omega_r$* is used for the command after it is multiplied by minus one (−1) at step 1225.

Returning to step 1219, if the answer in this step is YES, i.e., when the subtraction result becomes smaller than $F_N$, it means that the position of the cage 11 reaches the starting point of deceleration. Therefore, MOD is changed to three (step 1227) and thereafter the operation goes to step 1205. At this time, the answer of step 1205 becomes YES, and the operation goes to step 1229, at which the speed command V* for the deceleration is calculated in the analogous manner to step 1209, but instead of the acceleration $\alpha$, the deceleration $\beta$ is utilized in step 1229. Further, $k_b$ is a constant for converting the deceleration $\beta$ into a speed which is attained by the deceleration $\beta$ during $\Delta T$.

At step 1231, it is discriminated whether or not the speed command V* calculated at step 1229 is equal to or smaller than $V_1$, which is a speed by the first notch. If V* is larger than $V_1$, the operation goes to step 1207, and when V* is equal to or smaller than $V_1$, the operation goes to step 1207 after V* is set at $V_1$ (step 1233).

After the speed command generating task 67 is completed, the operation returns again to the main routine of FIG. 8. Then, at step 815, the control operation task 41 is executed. Since this task 41 has been already described in detail, the explanation thereof is omitted here.

At step 817, it is judged whether or not ΔT has lapsed from the execution of step 809. After the lapse of ΔT, the operation goes to step 819, at which it is discriminated whether or not the position interrupt signal occurs. If it does not occur, the operation returns to step 809, and the operation as mentioned above is repeated again. Therefore, it will be understood that the operation as mentioned above is repeatedly executed at time intervals of ΔT every time the position interrupt signal occurs.

Figure 13:
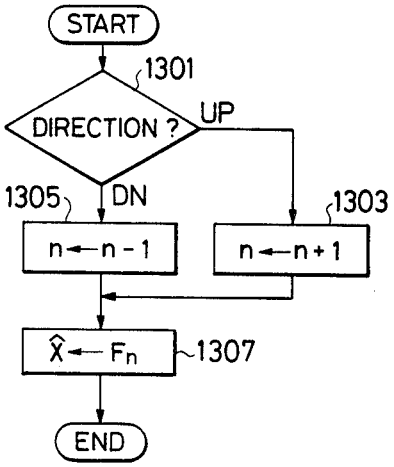
FIG. 13 is a flow chart showing details of a floor height correcting task included in the normal traveling routine of FIG. 8.

In the case where the position interrupt signal occurs, the operation goes to step 821, at which the floor height correcting task 65 is carried out. A detailed flow chart of the task 65 is shown in FIG. 13. As apparent from FIG. 8, the task 65 is executed only when the position interrupt signal occurs.

In FIG. 13, at first, the traveling direction of the cage 11 is discriminated at step 1301. If the cage 11 travels upward, one is added to the value n of the present floor when the position interrupt signal occurs, and the result (n+1) of the summation is stored in the predetermined area in the floor control work table as a new value of the present floor (step 1303).

On the contrary, if the cage 11 is in the downward traveling state, one is subtracted from the value n of the present floor, and the result (n−1) of the subtraction is stored in the predetermined area in the work table as a new value of the present floor (step 1305). Thereafter, the floor height value $F_n$ of the floor corresponding to n determined at step 1303 or 1305 is read out from the floor height table 59 (step 1307) and employed as the distance $\hat{X}$ of the present position of the cage 11 measured from the operating position of the downward limit switch 25.

When the floor height correcting task 65 ends, the operation returns again to the main routine of FIG. 8, and it is judged at step 823 whether or not the cage 11 reaches the destination floor. If it does not yet reach the destination floor, the operation returns to step 807 and is repeated in the same manner as described above until the cage 11 reaches the destination floor. When the cage 11 reaches the destination floor, a routine for stopping the cage 11 is executed at step 825. The principal function of the routine for stop is to open a power circuit and to effect the braking force. Thereafter, the operation of the normal traveling routine ends.

As described above, the present position of an elevator cage is detected by the calculation on the basis of one of the control amounts created in the course of the signal processing for the vector control of an induction motor for driving an elevator cage. Therefore, according to the present invention, any special position detector, such as an expensive rotary encoder, is not needed. Therefore, an economical elevator control apparatus can be achieved.

We claim:

1. A control apparatus for an elevator serving a plurality of floors having, an induction motor for driving a cage of the elevator;

inverter means, fed with appropriate DC power, for converting the DC power into AC power to supply said induction motor therewith;

operation management control means, which receives cage call signals generated in the cage and hall call signals generated in elevator halls of the floors and produces a traveling command including information of a present floor of the cage and a destination floor thereof to manage the operation of the cage for serving the floors;

signal processor means, responsive to the traveling command, in which a detected current of said induction motor is decomposed into an excitation component and a torque component, a rotating angular speed of said induction motor is detected on the basis of the torque component, and a control signal is generated to control said induction motor in such a manner that the detected rotating angular speed follows a command for the rotating angular speed determined in accordance with the traveling command; and inverter control means, in response to the control signal from said signal processor means, for producing gate signals for said inverter means, characterized in that said signal processor means calculates a present position of the cage on the basis of the detected rotating angular speed of said induction motor and generates the command for the rotating angular speed in accordance with the calculated present position of the cage.

2. An elevator control apparatus as defined in claim 1, wherein said signal processor means obtains an rotating angle of said induction motor by adding up the detected rotating angular speed every given time interval and calculates the present position of the cage on the basis of the above obtained rotating angle.

3. An elevator control apparatus as defined in claim 1, wherein there is further provided floor detector means for producing a position interrupt signal every time the cage passes a floor, and said signal processor means has a floor height table, in which the calculated position of the cage is stored as a floor height in response to the position interrupt signal.

4. An elevator control apparatus as defined in claim 3, wherein the present position of the cage is calculated by the floor height read out from the floor height table in response to a position interrupt signal and a position of the cage calculated on the basis of the detected rotating angular speed after occurrence of the position interrupt signal.

* * * * *